US005736814A

United States Patent [19]

Kinoshita et al.

[11] Patent Number: 5,736,814

[45] Date of Patent: Apr. 7, 1998

[54] VACUUM FLOURESCENT DISPLAY APPARATUS

[75] Inventors: Kazuya Kinoshita; Tadami Maeda, both of Mie, Japan

[73] Assignee: Ise Electronics Corporation, Japan

[21] Appl. No.: 708,501

[22] Filed: Sep. 5, 1996

[30] Foreign Application Priority Data

Sep. 6, 1995 [JP] Japan ..... 7-228852

[51] Int. Cl.[6] ..... H01J 31/15

[52] U.S. Cl. ..... 313/495; 315/496; 315/497

[58] Field of Search ..... 313/495, 496, 313/497, 422, 461, 463

[56] References Cited

U.S. PATENT DOCUMENTS 4,835,445 5/1989 Watanabe et al. ..... 313/497

5,150,005 9/1992 Yokono ..... 313/495

FOREIGN PATENT DOCUMENTS 5-1473 1/1996 Japan .

*Primary Examiner*—Sandra L. O'Shea

*Assistant Examiner*—Vip Patel

*Attorney, Agent, or Firm*—Blakely Sokoloff Taylor & Zafman

[57] ABSTRACT

A vacuum fluorescent display apparatus includes semiconductor chips and a phosphor layer. The semiconductor chips are disposed on a glass substrate and having semiconductor integrated circuits formed thereon. The phosphor layer includes phosphor pixels driven by the semiconductor integrated circuits and arranged on the semiconductor integrated circuits in a matrix with the same space in horizontal and vertical directions. A space between first and second arrays of the phosphor pixels that are formed on end portions of opposing sides of first and second semiconductor chips arranged adjacent to each other becomes equal to a space among the phosphor pixels arranged on the semiconductor integrated circuits.

3 Claims, 3 Drawing Sheets

VACUUM FLOURESCENT DISPLAY APPARATUS

BACKGROUND OF THE INVENTION

The present invention relates to a vacuum fluorescent display apparatus for displaying a pattern, e.g., a character and a symbol, by causing phosphors arranged in a matrix to emit light and, more particularly, to a vacuum fluorescent display apparatus in which semiconductor chips arranged in alignment and having phosphors arranged in a matrix are arranged on an insulating substrate.

FIGS. 3A to 3C explain the arrangement of a conventional vacuum fluorescent display apparatus, in which FIG. 3A shows the main part, FIG. 3B is taken along the line B—B' of FIG. 3A, and FIG. 3C shows a portion C of FIG. 3A. As shown in FIGS. 3A to 3C, semiconductor chips 2 made of, e.g., silicon, are arranged in two arrays on the major surface of a glass substrate 1. This glass substrate 1 constitutes part of a vacuum envelope. In addition to the semiconductor chips 2, a printed wiring layer (not shown) for connecting these semiconductor chips 2 with each other or with the outside is formed on the above-mentioned major surface of the glass substrate 1. A semiconductor integrated circuit necessary for performing vacuum fluorescent display is formed on the semiconductor chips 2 with a known method. A plurality of phosphor screen electrodes 3a1 having a rectangular shape or any other arbitrary shape are formed on the surface of each semiconductor chip 2 with a predetermined pitch P. A phosphor is formed on each phosphor screen electrode 3a1, thereby forming a phosphor pixel 3a. This group of phosphor pixels 3a constitutes a character display phosphor screen 3 on the surface of each semiconductor chip 2.

One end of each signal input bonding wire 4 is connected to a connecting portion formed on each of the upper and lower end portions of the semiconductor chip 2. The other end of the bonding wire 4 is connected to a predetermined position on the above-mentioned printed wiring layer formed on the glass substrate 1.

Although not shown, a mesh-like grid is disposed above (on the front side of the sheet of FIG. 3A) the plurality of semiconductor chips 2 arranged in alignment on the glass substrate 1. A plurality of filament-like cathodes extend above the grid in the longitudinal direction.

Although not shown, a spacer glass member is arranged around the glass substrate 1, and a transparent cover glass member is arranged on the spacer glass member to oppose it. The spacer glass member and the cover glass member are sealed with frit glass to hermetically seal a portion inside them, thereby forming the vacuum envelope together with the above-mentioned glass substrate 1.

Referring to FIGS. 3A to 3C, reference symbols $P_x$ and $P_y$ denote X- and Y-direction character pitches, respectively, of the plurality of semiconductor chips 2 arranged in alignment; and P, the X- and Y-direction pitch of the arrangement of the phosphor pixels 3a.

A vacuum fluorescent display apparatus of this type is known and is disclosed in, e.g., Japanese Patent Publication No. 5-1473.

However, in the vacuum fluorescent display apparatus having the above arrangement, while the phosphor pixels 3a formed on each semiconductor chip 2 are arranged in alignment with the pitch P, the semiconductor chips 2 are merely arranged in alignment with spaces considering only their characteristics, and a display pattern is not generally taken into consideration. Thus, when displaying one pattern by using the plurality of semiconductor chips 2, as the space between the semiconductor chips 2 differs from the space between the phosphor pixels 3a, the displayed pattern sometimes becomes different from a pattern which is originally aimed at.

More specifically, in the conventional vacuum fluorescent display apparatus, in the region of one semiconductor chip 2, the phosphor pixels 3a are arranged with the same space P, as shown in FIG. 3C. However, between the two adjacent semiconductor chips 2, the space between the phosphor pixels 3a is not P. Thus, when one character is displayed by using the two semiconductor chips 2, the obtained character may be undesirably separated into two portions or be displayed as an undesirably long character. A target character cannot thus be displayed properly.

The vacuum fluorescent display apparatus with the conventional arrangement has a problem in the continuity of its phosphor pixels 3a, and a full-graphic display is impossible to obtain. This is because, in the conventional vacuum fluorescent display apparatus, the signal input/output bonding wires are extracted from signal terminals 4a arranged at the upper and lower end portions (upper and lower sides) of each semiconductor chip 2.

If the signal terminals 4a are arranged between the adjacent semiconductor chips 2 in this manner, the space between the semiconductor chips 2 in the direction of the signal terminals 4a is increased by the length of the signal terminals 4a, and accordingly becomes greatly different from the space between the phosphor pixels 3a formed on each semiconductor chip 2. Hence, the phosphor screens 3 on the respective semiconductor chips 2 cannot be arranged to be close to the optimum state. As a result, in the conventional vacuum fluorescent display apparatus, the phosphor screens 3 cannot be set in a continuous state over the plurality of semiconductor chips 2 in the direction of the region where the signal terminals 4a are arranged.

In the graphic display of the vacuum fluorescent display apparatus, dot-like phosphor screen electrodes having a required pixel count may be formed on a desired wide-area substrate with a predetermined pitch. To form such a large number of dot-like phosphor screen electrodes and phosphors on them, the screen printing technique is conventionally generally employed. With this technique, however, the diameter of dot that can be formed is limited to about 250 μm, and a high-resolution dot matrix cannot be formed.

In order to solve these problems, if the manufacturing methods such as photolithography and etching that are used in manufacturing a semiconductor integrated circuit are utilized, a finer micropattern can be formed. More specifically, first, a semiconductor substrate is employed, and wires and the like are formed on the semiconductor substrate in accordance with the semiconductor integrated circuit manufacturing technique. Then, phosphor screen electrodes and phosphors may be formed on the semiconductor chips in accordance with the semiconductor integrated circuit manufacturing technique.

When the semiconductor substrate is employed in this manner, a finer wiring pattern and a finer phosphor screen electrode pattern can be formed easily. In other words, the degree of integration of dots comprising phosphor screen electrodes can be increased. When phosphors are formed on the phosphor screen electrodes in the same manner, a high-resolution dot matrix can be realized.

With this semiconductor integrated circuit manufacturing technique, however, although a finer micropattern can be formed, if uniform fine dots are to be formed over a wide area, a very high cost is required. For this reason, when utilizing the semiconductor integrated circuit manufacturing technique, if fine phosphor screen electrodes and phosphors are formed on a small semiconductor chip in a matrix and a plurality of semiconductor chips each obtained in this manner are arranged, a wider-area display region can be obtained.

As described above, however, even if the plurality of semiconductor chips 2 are used, since the continuity of the phosphor pixels 3*a* is limited, a full-graphic display cannot be achieved by disposing the plurality of semiconductor chips 2.

SUMMARY OF THE INVENTION

The present invention has been made to solve the conventional problems described above, and has as its object to enable a plurality of graphic displays or a full-graphic display by eliminating the discontinuity or the limitation in continuity of the phosphor pixel arrangement.

In order to achieve the above object, according to the present invention, there is provided a vacuum fluorescent display apparatus comprising semiconductor chips disposed on an insulating substrate and having semiconductor integrated circuits formed thereon, and a phosphor screen comprising phosphor pixels driven by the semiconductor integrated circuits and arranged on the semiconductor integrated circuits in a matrix with the same space in horizontal and vertical directions, wherein a space between first and second arrays of the phosphor pixels that are formed on end portions of opposing sides of first and second semiconductor chips arranged adjacent to each other becomes equal to a space among the phosphor pixels arranged on the semiconductor integrated circuits.

BRIEF DESCRIPTION OF THE DRAWINGS

FIGS. 1A and 1B show the arrangement of a vacuum fluorescent display apparatus according to the first embodiment of the present invention, in which FIG. 1A is a sectional view and FIG. 1B is a sectional view taken along the line A—A' of FIG. 1A;

FIGS. 3A to 3C are views for explaining the arrangement of a conventional vacuum fluorescent display apparatus, in which FIG. 3A is a plan view of the main part, FIG. 3B is a sectional view taken along the line B—B' of FIG. 3A, and FIG. 3C is an enlarged plan view of a portion C of FIG. 3A.

DESCRIPTION OF THE PREFERRED EMBODIMENTS

The preferred embodiments of the present invention will be described with reference to the accompanying drawings.

First Embodiment

The first embodiment of the present invention will be described with reference to FIGS. 1A and 1B.

Figure 1A:
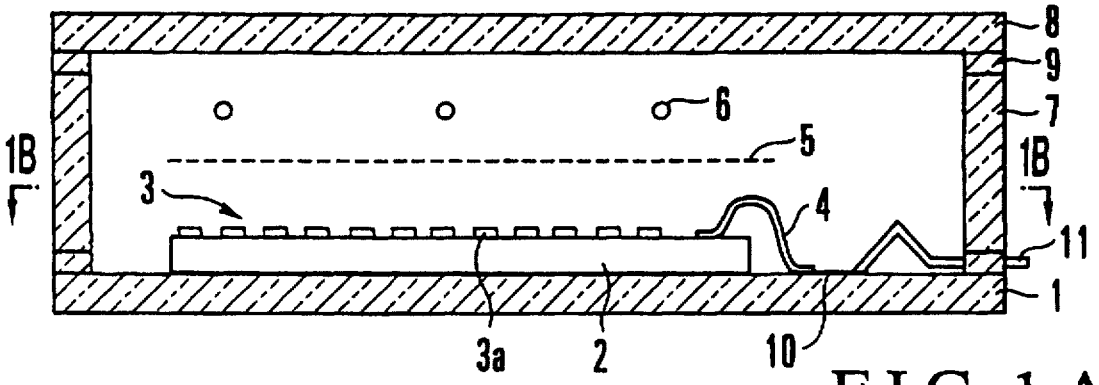
Figure 1B:
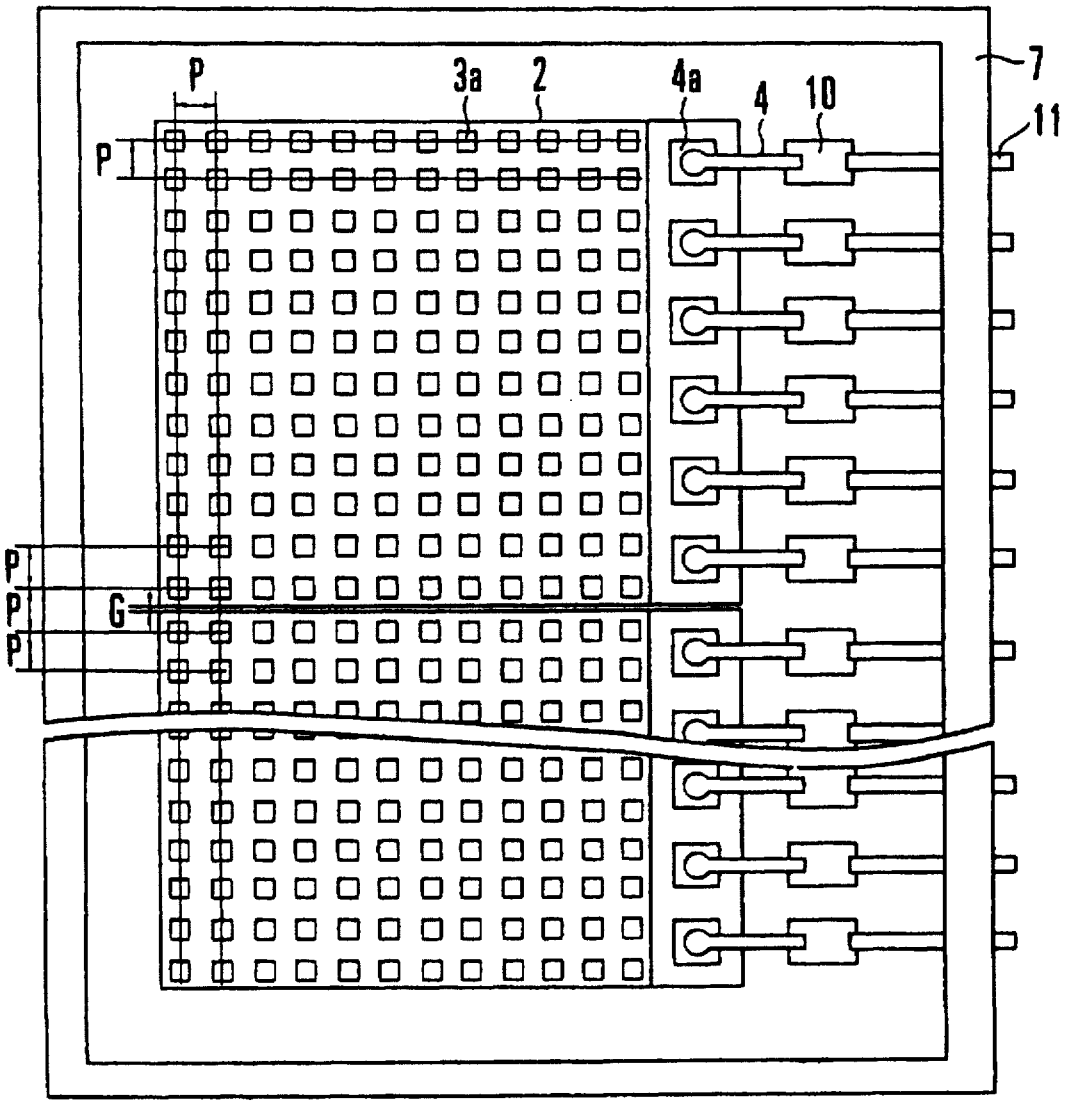

FIG. 1A shows a vacuum fluorescent display apparatus according to the first embodiment of the present invention, and FIG. 1B shows a section taken along the line A—A' of FIG. 1A.

As shown in FIGS. 1A and 1B, semiconductor chips 2 made of silicon or the like are arranged on a glass substrate 1, and signal input/output bonding wires 4 are extracted from one side of each semiconductor chip 2.

A phosphor layer 3 comprising phosphor pixels 3*a* is formed on each semiconductor chip 2. The phosphor pixels 3*a* are formed on dot-like phosphor screen electrodes arranged in a matrix with a pitch of a distance P both in the horizontal and vertical directions. In FIGS. 1A and 1B, the phosphor screen electrodes are omitted.

An electron diffusion grid 5 and a cathode 6 are arranged above the semiconductor chips 2.

The semiconductor chips 2, the electron diffusion grid 5, and the cathode 6 are enclosed by the glass substrate 1 and a front glass member 8 arranged to oppose the glass substrate 1 through a spacer glass member 7, and are sealed with sealing frit glass members 9.

A space formed by the glass substrate 1 and the front glass member 8 arranged to oppose the glass substrate 1 through the spacer glass member 7 is evacuated.

The bonding wires 4 are connected to lead pins 11 on the glass substrate 1 through bonding pads 10. The lead pins 11 extend to the outside through the corresponding sealing frit glass member 9 sandwiched between the glass substrate 1 and the spacer glass member 7.

As shown in FIG. 1B, the semiconductor chips 2 are arranged with a space of a distance G between them. This distance G is smaller than the distance P which is the space between the phosphor pixels 3*a*. The semiconductor chips 2 are arranged such that the phosphor pixels 3*a* are arranged with the space of the distance P both in the horizontal and vertical directions over the adjacent semiconductor chips 2. As a result, on the entire range of each semiconductor chip 2, the phosphor pixels 3*a* are arranged in a matrix with the space of the distance P both in the horizontal and vertical directions.

According to the first embodiment, since the phosphor pixels 3*a* are arranged uniformly on the entire range of each semiconductor chip 2, the array of phosphor pixels 3*a* attains continuity. As a result, a plurality of graphic displays or a full-graphic display becomes possible.

Second Embodiment

Figure 2A:
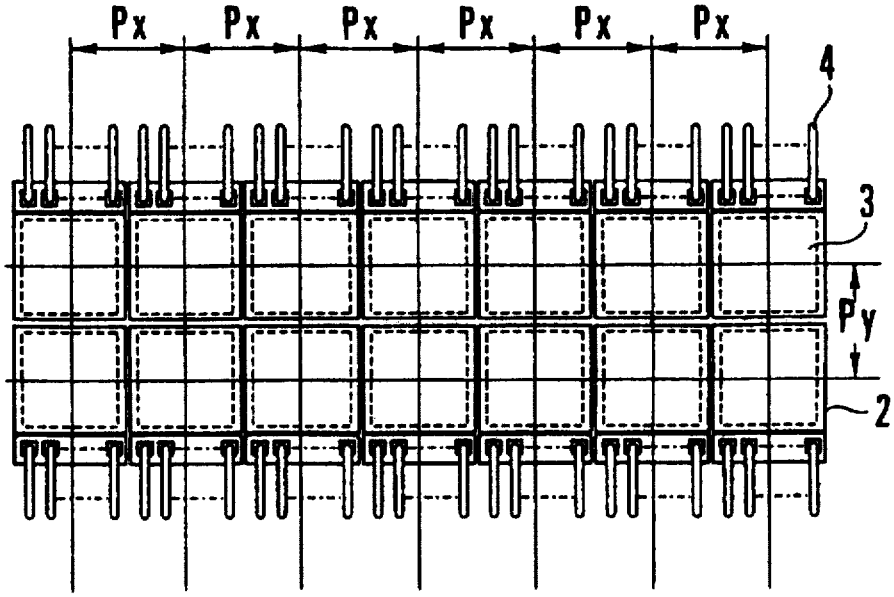
FIGS. 2A and 2B are plan views showing the arrangement of a vacuum fluorescent display apparatus according to the second embodiment of the present invention.

The second embodiment of the present invention will be described with reference to FIGS. 2A and 2B.

In the first embodiment, the semiconductor chips 2 are arranged in one array. However, the present invention is not limited to this, and semiconductor chips 2 may be arranged in two arrays, as shown in FIG. 2A. In this case, the two arrays of semiconductor chips 2 are arranged to oppose each other with their sides opposite to their sides where signal input/output bonding wires 4 are extracted. The semiconductor chips 2 are arranged with the same distance G both in the X and Y directions.

Figure 2B:
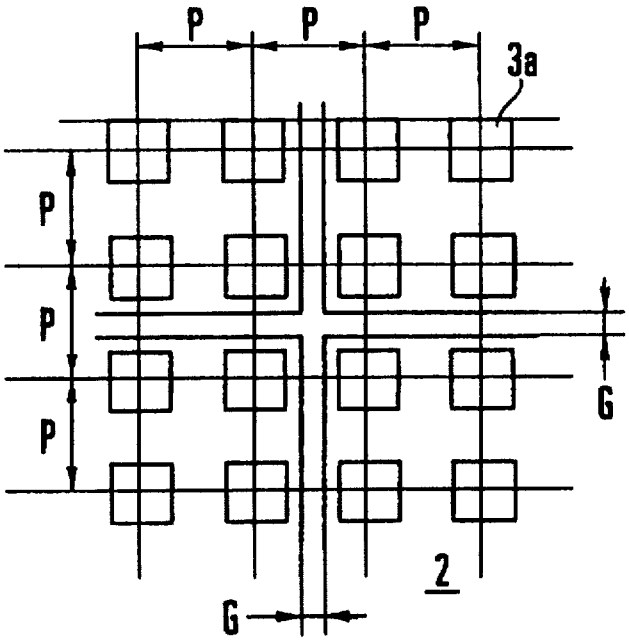
Figure 3A:
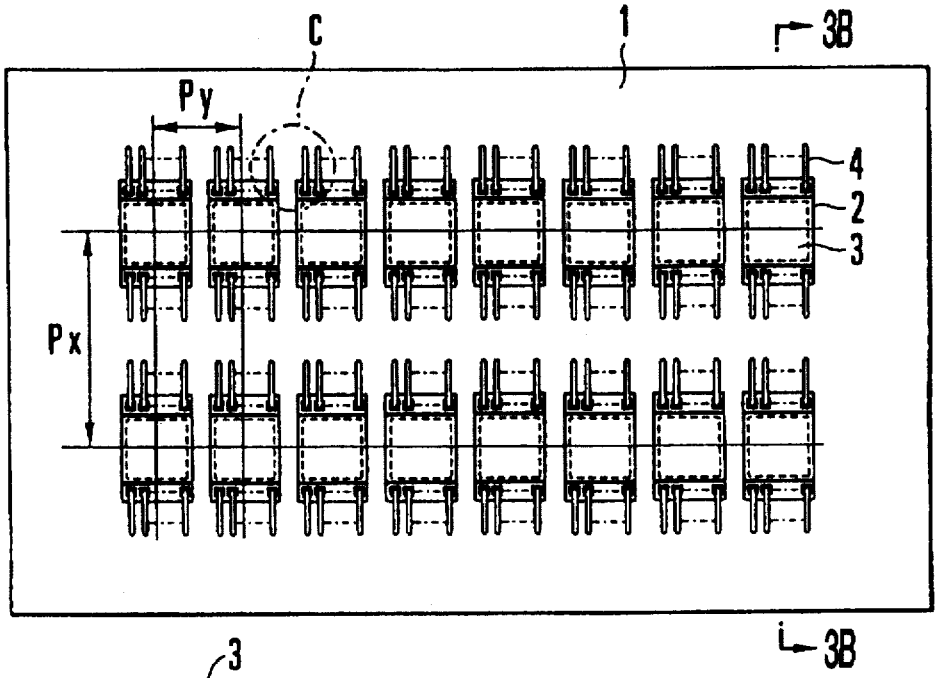
FIG. 3A PRIOR ART
Figure 3B:
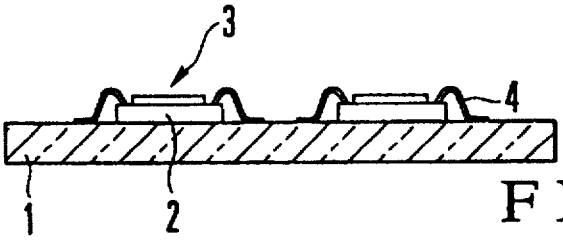
FIG. 3B PRIOR ART
Figure 3C:
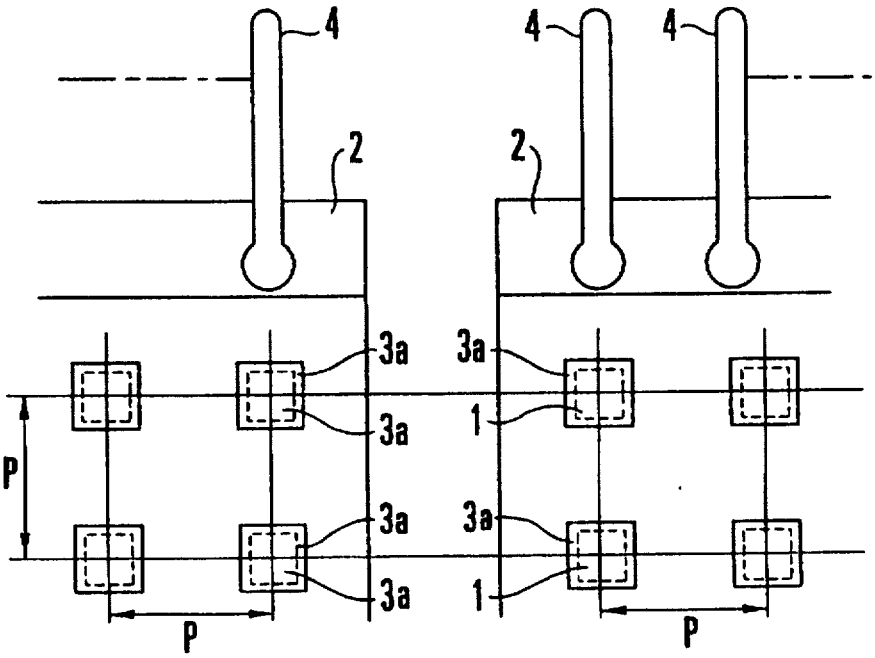
FIG. 3C PRIOR ART

Hence, as shown in FIG. 2B, in a region including four semiconductor chips 2, respective phosphor pixels 3*a* are arranged in the following manner. More specifically, the phosphor pixels 3*a* formed on the major surfaces of the semiconductor chips 2 are arranged in a matrix with a pixel array pitch of the same distance P both in the horizontal and vertical directions over the four adjacent semiconductor chips 2. The semiconductor chips 2 can be arranged in a matrix on the major surface of the glass substrate 1 with an X-direction character pitch $P_x$ and a Y-direction character pitch $P_y$ that are equal to each other.

As described above, according to the second embodiment, the plurality of semiconductor chips 2 are arranged on the major surface of the glass substrate 1 with the same pitch ($P_x$–$P_y$) in the X and Y directions, and the plurality of phosphor pixels 3*a* are arranged on the major surfaces of the semiconductor chips 2 with the same pitch P both in the horizontal and vertical directions. As a result, within a region where the semiconductor chips 2 are arranged, the limitation on continuity of the phosphor pixels 3*a* is eliminated. Hence, when the display screen is divided into a plurality of regions as required, a plurality of graphic screens can be formed. Also, the entire display surface can form one graphic screen.

As has been described above, according to the present invention, the space between the first and second arrays of phosphor pixels that are formed on the end portions of the opposing sides of the first and second semiconductor chips arranged adjacent to each other becomes equal to the space between the phosphor pixels on the first and second semiconductor chips.

As a result, even if a plurality of semiconductor chips are arranged, the phosphor pixels are arranged with the same pitch in the horizontal and vertical directions on the entire range of the semiconductor chips. Therefore, the limitation on continuity of the phosphor pixels is eliminated, and a plurality of graphic displays or a full-graphic display can be obtained, which is very excellent in effect.

In a semiconductor chip, the signal terminals are extracted from its one side. Thus, while the phosphor pixels are arranged with the same pitch in the horizontal and vertical directions on the entire range, even if the semiconductor chips are arranged in two arrays, they can be arranged with the same pitch in the X and Y directions.

What is claimed is:

1. A vacuum fluorescent display apparatus comprising:

semiconductor chips disposed on an insulating substrate and having semiconductor integrated circuits formed thereon; and a phosphor screen comprising phosphor pixels driven by said semiconductor integrated circuits and arranged on said semiconductor integrated circuits in a matrix with the same space in horizontal and vertical directions, wherein a space between first and second arrays of said phosphor pixels that are formed on end portions of opposing sides of first and second semiconductor chips arranged adjacent to each other is equal to a space among said phosphor pixels arranged on said semiconductor integrated circuits.

2. An apparatus according to claim 1, wherein said plurality of semiconductor chips are arranged in one array.

3. An apparatus according to claim 1, wherein said plurality of semiconductor chips are arranged in two arrays close to each other with a space therebetween equal to a distance between said first and second semiconductor chips, and signal terminals are extracted from a side of each of said semiconductor chips which has no adjacent semiconductor chip.

* * * * *